United States Patent [19]

Jacobson et al.

[11] 4,182,033

[45] Jan. 8, 1980

[54] SCRAPER ASSEMBLY

[75] Inventors: Chester F. Jacobson, Southboro; Norman D. Poisson, Andover, both of Mass.

[73] Assignee: The Gillette Company, Boston, Mass.

[21] Appl. No.: 894,596

[22] Filed: Apr. 7, 1978

[51] Int. Cl.[2] ..... B26B 5/00

[52] U.S. Cl. ..... 30/169; 30/162

[58] Field of Search ..... 30/162, 169, 40, 286, 30/125; 221/66, 102

[56] References Cited

U.S. PATENT DOCUMENTS

| | | | |
|---|---|---|---|
| 739,371 | 9/1903 | Allen | 30/286 |
| 889,004 | 5/1908 | Hansen | 30/151 |
| 2,641,358 | 6/1953 | Santo | 221/102 X |
| 2,779,991 | 2/1957 | Bolick | 30/162 X |
| 3,771,225 | 11/1973 | Unger | 30/169 |
| 3,855,700 | 12/1974 | Gerson | 30/169 X |

*Primary Examiner*—Jimmy C. Peters

*Attorney, Agent, or Firm*—Richard A. Wise; Scott R. Foster

[57] ABSTRACT

A scraper assembly comprising a housing having a head portion adapted to receive and retain a blade unit, and a cover member adapted to cover the blade retained by the head portion, the cover member being releasably retained by engagement with the head portion and completely separable therefrom, the cover member being further adapted to cover portions of the housing remote from the head portion, the cover member being releasably retained by engagement with a second portion of the housing and completely separable therefrom, whereby the cover member may be selectively positioned to cover the blade unit and may be removed therefrom and positioned on the housing at an end remote from the blade unit to expose the blade unit for scraping operations, and may be completely removed from the remainder of said assembly.

4 Claims, 3 Drawing Figures

SCRAPER ASSEMBLY

BACKGROUND OF THE INVENTION

1. Field of the Invention

This invention relates to scraper devices, and is directed more particularly to a scraper assembly for use with razor blades of a known type.

2. Description of the Prior Art

Scraper devices are generally well known in the art and in basic form include a handle having a blade of some sort attached thereto. A free edge of the blade is brought to bear against a surface sought to be scraped clean, as in the case of removing a sticker or paint from glass, or removing peeling paint from a surface, etc. In instances where the free edge is sharpened, care must be exercised to prevent the edge from inflicting harm to persons and articles which might come in contact with the edge. Some scrapers are adapted to utilize razor blades, which are very useful in providing a good scraping edge but which also present an element of danger in view of the cutting capability of the edge.

SUMMARY OF THE INVENTION

It is, therefore, an object of the present invention to provide a scraper assembly including a razor blade as a scraping element and further including a cover member for covering the blade edge when not in use.

A further object of the invention is to provide such an assembly in which the cover member may be removed from its blade covering position and be attached to the assembly in a second position where the cover member functions as a grip portion of the assembly. Thus, the cover member is easily kept track of and always serves as a working component of the assembly.

With the above and other objects in view, as will hereinafter appear, a feature of the present invention is the provision of a scraper assembly comprising a housing having two parallel elongated sides interconnected by first and second ends and having a head portion adapted to receive and retain a blade unit, and a cover means adapted to cover the blade retained by the head portion, the cover means having two parallel elongated walls engageable with said sides respectively, and first and second end walls engageable with said ends respectively, said cover member being releasably retained by engagement with the head portion and being completely separable therefrom, the cover means being further adapted to cover portions of the housing remote from the head portion, the cover means being releasably retained by engagement with a second portion of the housing, and being completely separable therefrom whereby the cover means may be selectively positioned to cover the blade unit and may be removed therefrom and positioned on the housing at an end remote from the blade unit to expose the blade unit for scraping operations and may be completely removed from the remainder of the assembly.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
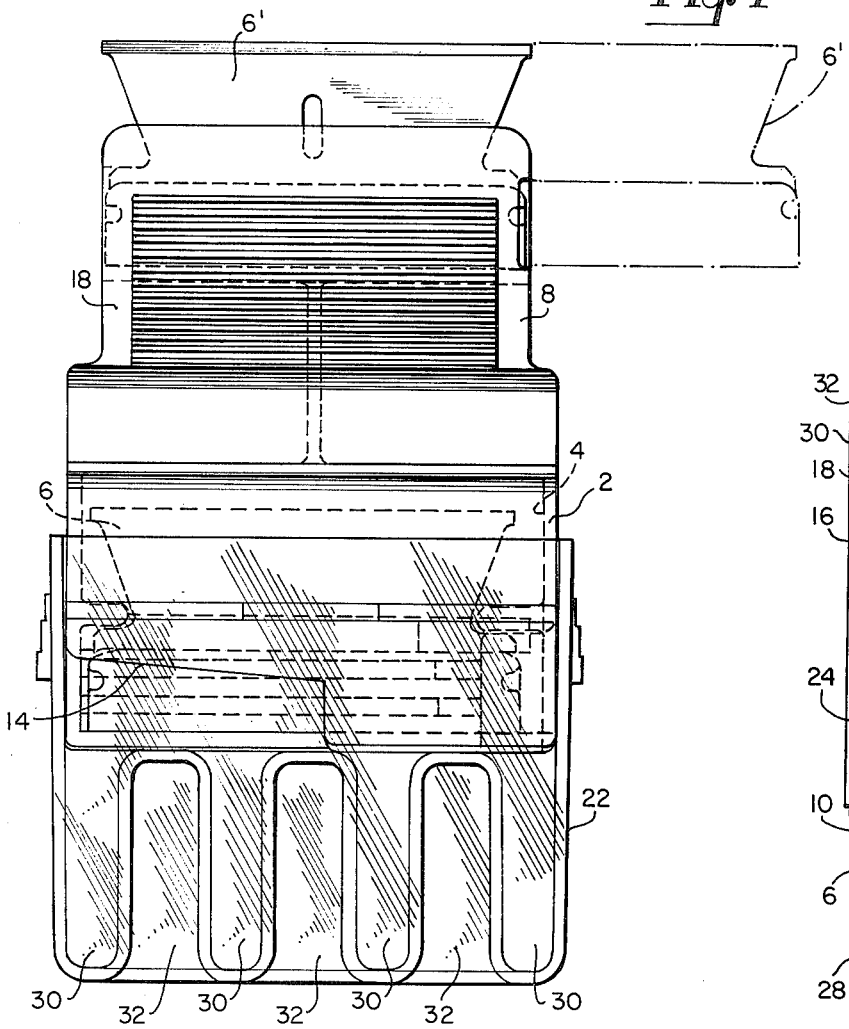
FIG. 1 is a side elevational view of one form of scraper assembly illustrative of an embodiment of the invention and showing a cover portion thereof in a first selected position.

Referring to the drawings, it will be seen that the illustrative embodiment includes a housing 2 having a chamber 4 therein adapted to receive and releasably retain blade units 6. The housing 2 is further provided with a head portion 8 which is adapted to receive and retain a selected one 6' of the blade units 6.

Figure 2:
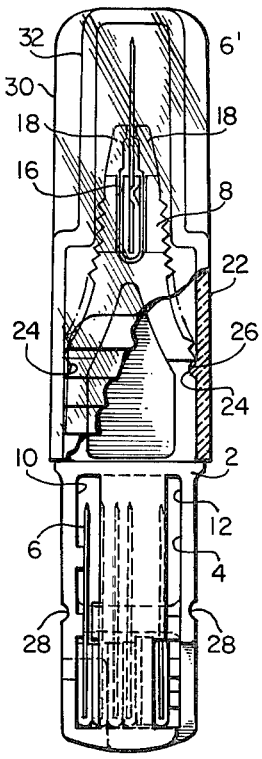
FIG. 2 is an end elevational view, in part broken away, of the scraper assembly of FIG. 1 but with the cover means shown in a second selected position.
Figure 3:
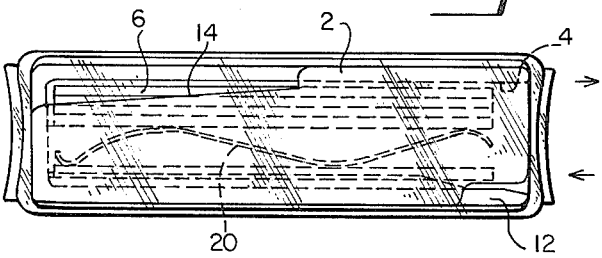
FIG. 3 is a bottom view of the assembly.

The housing 2 is provided with first and second openings 10, 12, as best seen in FIG. 2, the opening 10 being for the purpose of removing blades from the chamber 4 and the opening 12 being for the purpose of receiving used blades to be discarded in the chamber 4. The housing 2 is further provided with a slot 14 which enables an operator to press with a thumb or finger upon a blade 6 in the chamber 4 and urge the blade out the opening 10.

The head portion 8 of the housing 2 includes a recess 16 configured and adapted to receive the selected blade unit 6'. The recess 16 is preferably formed by opposed members 18 which have sufficient resiliency to permit the blade unit 6' to be inserted therebetween and exercise a retaining influence on the blade unit.

In the chamber 4 there is preferably provided a spring means, which may be in the form of a leaf spring 20, which operates to separate the new blades from the used blades, and further operates to bias the blades toward the outside walls of the chamber 4 so as to prevent the blades from falling loosely about in the chamber.

The assembly further includes a cover member 22, which may be used to cover a blade held by the head portion 8, as shown in FIG. 2, or may be removed from the head portion and attached to the housing 2 at the other end thereof, as shown in FIG. 1. To facilitate attachment of the cover member 22 to the housing 2, at either end thereof, the cover member 22 is provided with inwardly directed detents 24 configured to engage a first set of recesses 26 as illustrated in FIG. 2, and to engage a second set of recesses 28, as shown in FIG. 1 (the recesses 28 being illustrated in FIG. 2). Preferably, the exterior of the cover member 22 is provided with a series of ribs 30, separated by depressions 32, the arrangement of ribs and depressions providing a gripping means by which the assembly may be gripped by an operator when the cover member is placed in the position shown in FIG. 1.

In operation, an operator by insertion of a thumb or finger in the slot 14 urges a blade 6 out the opening 10. As the blade 6 emerges from the opening 10, the operator may grasp the blade and reposition it adjacent the recess 16 formed by the opposed members 18. The operator forces the selected blade 6' into the recess 16 against frictional resistance. When the blade is fully disposed in the head portion 8 of the assembly, the operator is ready for scraping operations, having placed the cover member 22 in the position shown in FIG. 1 by engagement of the detents 24 with the second set of recesses 28. Upon completion of a scraping operation, the cover member 22 is removed from the second set of recesses 28 and placed in the position shown in FIG. 2 whereby to protect the otherwise exposed edge of the blade 6', by snapping the detents 24 into the first set of recesses 26, as illustrated in FIG. 2. In subsequent uses, the cover member 22 may be removed from its edge protecting position and placed in the position shown in FIG. 1 to be used as a gripping means for the assembly. When the blade is dulled, it may be removed from the recess 16 and inserted through the opening 12 into the chamber 4. The spring means 20 operates to separate the used blades from the new blades and further operates to retain the blades in the chamber so as not to be moving about during a scraping operation.

It is to be understood that the present invention is by no means limited to the particular construction herein disclosed and/or shown in the drawings, but also comprises any modifications or equivalants within the scope of the disclosure.

Having thus described our invention, what we claim as new and desire to secure by Letters Patent of the United States is:

1. A scraper assembly comprising a housing having two generally parallel elongated sides interconnected by first and second ends and having a head portion adapted to receive and retain a blade unit, and a cover member adapted to cover said blade unit retained by said head portion, said cover member having two generally parallel elongated walls engageable with said sides respectively, and first and second end walls engageable with said ends respectively, said cover member and said head portion being provided with detent and recess means to facilitate engagement of said cover member and said head portion and to facilitate removal of said cover member from said head portion, said cover member being further adapted to cover portions of said housing remote from said head portion, said cover member being releasably retained by engagement with a second portion of said housing and completely separable therefrom, said cover member, when in engagement with said second portion of said housing remote from said blade unit being adapted to serve as a grip portion for said assembly, whereby said cover member may be selectively positioned to cover said blade unit and may be removed therefrom and positioned on said housing remote from said blade unit to expose said blade unit for scraping operations, and may be completely removed from the remainder of said assembly.

2. The invention in accordance with claim 1 in which said cover member and said second portion are provided with detent and recess means to facilitate said engagement of said cover member and said second portion and to facilitate removal of said cover member from said second portion.

3. The invention in accordance with claim 1 in which said cover member is provided on its exterior with a series of ribs and depressions to facilitate its use as said grip portion for said assembly.

4. The invention in accordance with claim 3 in which said cover member depressions engage portions of said head portion when said cover is in position to cover said blade unit.

* * * * *